US008734302B2

(12) United States Patent
Hsieh

(10) Patent No.: US 8,734,302 B2
(45) Date of Patent: May 27, 2014

(54) TREADMILL WITH WORKSTATION

(76) Inventor: Paul Hsieh, City of Industry, CA (US)

( * ) Notice: Subject to any disclaimer, the term of this patent is extended or adjusted under 35 U.S.C. 154(b) by 222 days.

(21) Appl. No.: 13/373,124

(22) Filed: Nov. 4, 2011

(65) Prior Publication Data

US 2013/0116095 A1 May 9, 2013

(51) Int. Cl.
*A63B 22/02* (2006.01)

(52) U.S. Cl.
USPC ..... 482/54

(58) Field of Classification Search
USPC ..... 482/51, 54, 139, 904, 910; 119/700; 108/42, 44, 77, 80–82
See application file for complete search history.

(56) References Cited

U.S. PATENT DOCUMENTS

| | | | | |
|---|---|---|---|---|
| 6,808,475 | B2 * | 10/2004 | Kehrbaum | 482/54 |
| 7,335,147 | B2 * | 2/2008 | Jones et al. | 482/148 |
| 7,614,991 | B2 * | 11/2009 | Fox | 483/54 |
| 7,686,742 | B2 * | 3/2010 | Tischler et al. | 482/57 |
| 7,887,021 | B2 * | 2/2011 | Shevin-Sandy | 248/447.1 |
| 7,892,148 | B1 * | 2/2011 | Stauffer et al. | 482/54 |
| 7,892,150 | B1 * | 2/2011 | Colley | 482/54 |
| 8,104,411 | B2 * | 1/2012 | Fenton | 108/42 |
| 8,485,945 | B2 * | 7/2013 | Leonhard | 482/52 |
| 2005/0148440 | A1 * | 7/2005 | Denton | 482/54 |
| 2006/0247109 | A1 * | 11/2006 | Powell | 482/148 |
| 2008/0234111 | A1 * | 9/2008 | Packham | 482/54 |
| 2012/0088633 | A1 * | 4/2012 | Crafton | 482/1 |
| 2013/0116092 | A1 * | 5/2013 | Martinez et al. | 482/9 |

* cited by examiner

*Primary Examiner* — Loan H Thanh
*Assistant Examiner* — Jennifer M Deichl
(74) *Attorney, Agent, or Firm* — Raymond Y. Chan; David and Raymond Patent Firm

(57) ABSTRACT

A treadmill includes a tread assembly, a supporting frame, a control unit and a tread utility assembly. The supporting frame has a lower end portion connected to a front end portion of the tread assembly, and an upper end portion extended from the lower end portion at a predetermined evaluation. The control unit is mounted at the upper end portion of the supporting frame for controlling an operation of the tread assembly. The tread utility assembly includes a utility member frontwardly and movably extended from the control unit to form a utility platform which has a predetermined angle of inclination with respect to the control unit, wherein a user is allowed to simultaneously operate the control unit and run on the tread assembly, and accomplish a predetermined task on the utility platform in a convenient and safe manner.

7 Claims, 7 Drawing Sheets

TREADMILL WITH WORKSTATION

BACKGROUND OF THE PRESENT INVENTION

1. Field of Invention

The present invention relates to a treadmill, and more particularly to a treadmill comprising a tread utility assembly which is capable of facilitating accomplishment of a wide variety of tasks when a user is exercising on the treadmill.

2. Description of Related Arts

A conventional treadmill, such as that disclosed in U.S. Pat. No. 7,892,148 usually comprises a tread assembly, a support structure extended from the tread assembly, a tabletop member mounted to a distal top end of the support structure, a handle member supported by the table top member adjacent the front edge of the table top member, and a control assembly including at least one input button supported by at least one of the table top member and the handle member. The table top member includes an undersurface and the control assembly is mounted to the undersurface of the table top member adjacent the front edge of the table top member and below the handle member.

There are several disadvantages in association with this conventional treadmill. First, the treadmill disclosed above can only be used for running and for workstation. While the user is running on the tread assembly, the user may simultaneously work on the table top member. The control unit is hidden underneath the table top member. This arrangement substantially reduces the feeling of exercise on the part of the user. The user acts like he is using the treadmill as a workstation without involving into exercising.

The second disadvantage relates to safety issues. Since the user does not have the feeling of exercise, he or she may over-concentrate on his or her work and therefore forgets the fact that the tread assembly is still running. This is extremely dangerous because the user may concentrate in reading or typing a document or email without being aware that he or she needs to keep up his or speed to run. When the user slows down his or her running speed, he or she may fall from the tread assembly.

Third, the conventional treadmill described above does not allow the user to perform something else while exercising. What this means is that the workstation comes with the treadmill and the user has no option to make it function as something else, such as a coffee table or a drinks table. In other words, the user may purchase the conventional treadmill with a view to perform some work but later finds that the workstation cannot be used to perform something else. For example, the user may later want the workstation to be used as a platform for putting his or her personal belongings.

Fourth, the workstation is suspendedly supported by the support structure which usually comprises a plurality of supporting shafts upwardly extended from the tread assembly, wherein the workstation is mounted on top end portions of the supporting shafts. The problem with this construction is that when the user is running on the tread assembly, the entire treadmill will shake as a result. The workstation will not be securely supported by the supporting shafts alone and the electronic equipments placed on the workstation, such as computers, may be affected or even damaged by the impact generated by the vibrations.

Fifth, the workstation supported on the treadmill is generally not movable. This means that the user will not be able to adjust the angle of inclination of the workstation with respect to the supporting shafts. This limitation brings great inconvenience to the user of the conventional treadmill.

SUMMARY OF THE PRESENT INVENTION

The invention is advantageous in that it provides a treadmill comprising a tread utility assembly which is capable of facilitating accomplishment of a wide variety of tasks when a user is exercising on the treadmill.

Another advantage of the invention is to provide a treadmill comprising a tread utility assembly, which is securely yet adjustably mounted on a tread assembly so as to allow the tread utility assembly to be used as a wide variety of equipments and platforms, and to suit a wide variety of users having different heights and exercising parameters.

Another advantage of the invention is to provide a treadmill comprising a tread utility assembly which is outwardly extended from a control unit so that a user is able to easily operate on the control unit while allowing other activities to be carried out by the tread utility assembly. More importantly, this construction does not jeopardize the feeling of exercise on the part of the user because the user will mainly be concerned with controlling the exercising parameters of the treadmill. In other words, exercise activities are given first priority when the user is using the treadmill of the present invention.

Another advantage of the invention is to provide a treadmill comprising a plurality of handle bars extended from the control unit for providing adequate support to the user of the present invention. This is in stark contrast with conventional treadmill described above because the workstation was the sole support given to the user.

Another advantage of the invention is to provide a treadmill comprising a tread utility assembly which is arranged to form a triangular support structure for providing secure yet movable support to a utility member.

Additional advantages and features of the invention will become apparent from the description which follows, and may be realized by means of the instrumentalities and combinations particular point out in the appended claims.

According to the present invention, the foregoing and other objects and advantages are attained by providing a treadmill, comprising:

a tread assembly comprising a movable runner tread for a user to run thereon;

a supporting frame having a lower end portion connected to a front end portion of the tread assembly, and an upper end portion extended from the lower end portion at a predetermined evaluation;

a control unit mounted at the upper end portion of the supporting frame for controlling an operation of the tread assembly; and a tread utility assembly comprising a utility member outwardly and movably extended from the control unit to form a utility platform which has a predetermined angle of inclination with respect to the control unit, wherein a user is allowed to simultaneously operate the control unit and run on the tread assembly, and accomplish a predetermined task on the utility platform in a convenient and safe manner.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
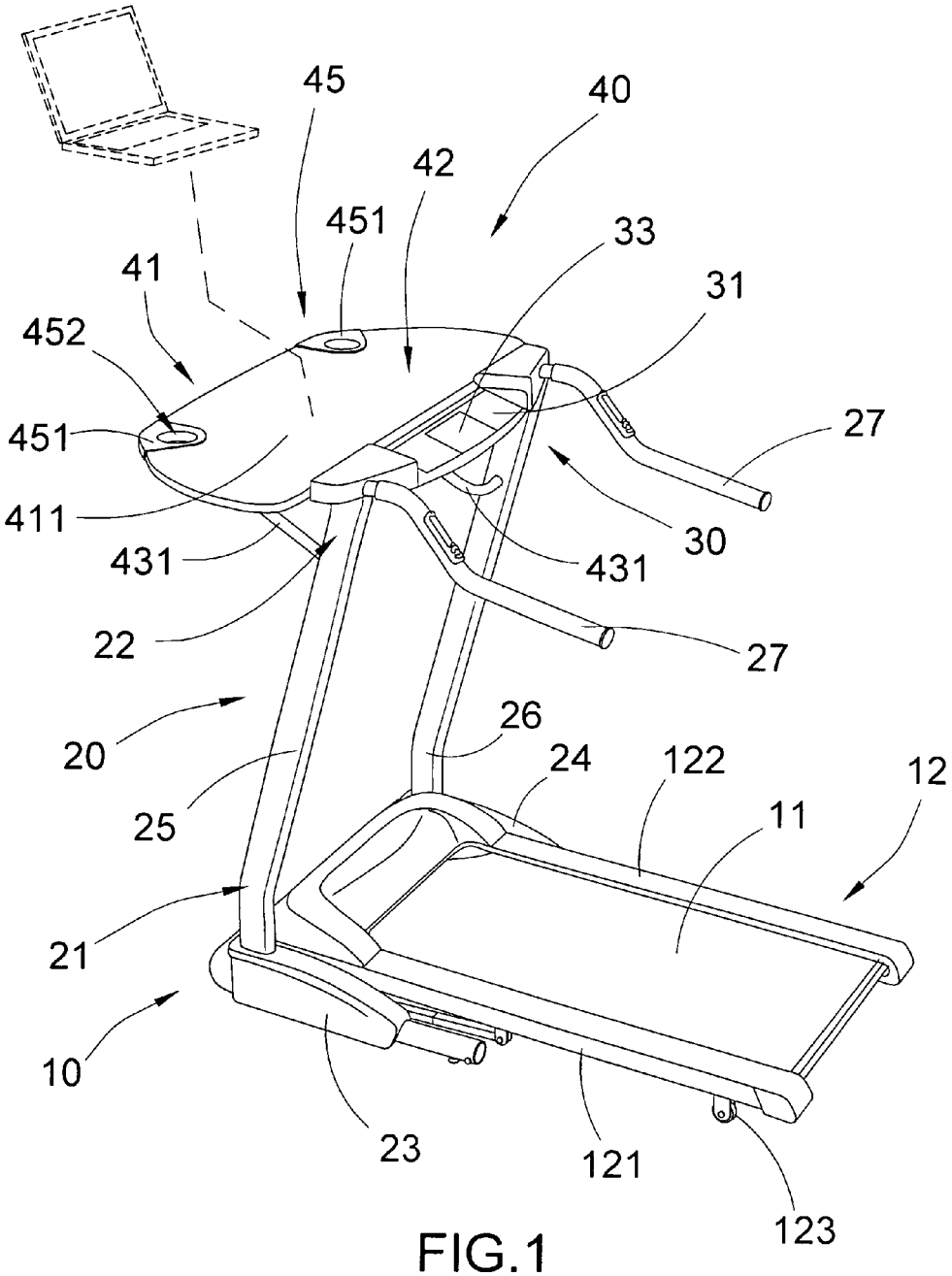
FIG. 1 is a perspective view of a treadmill according to a preferred embodiment of the present invention.
Figure 2:
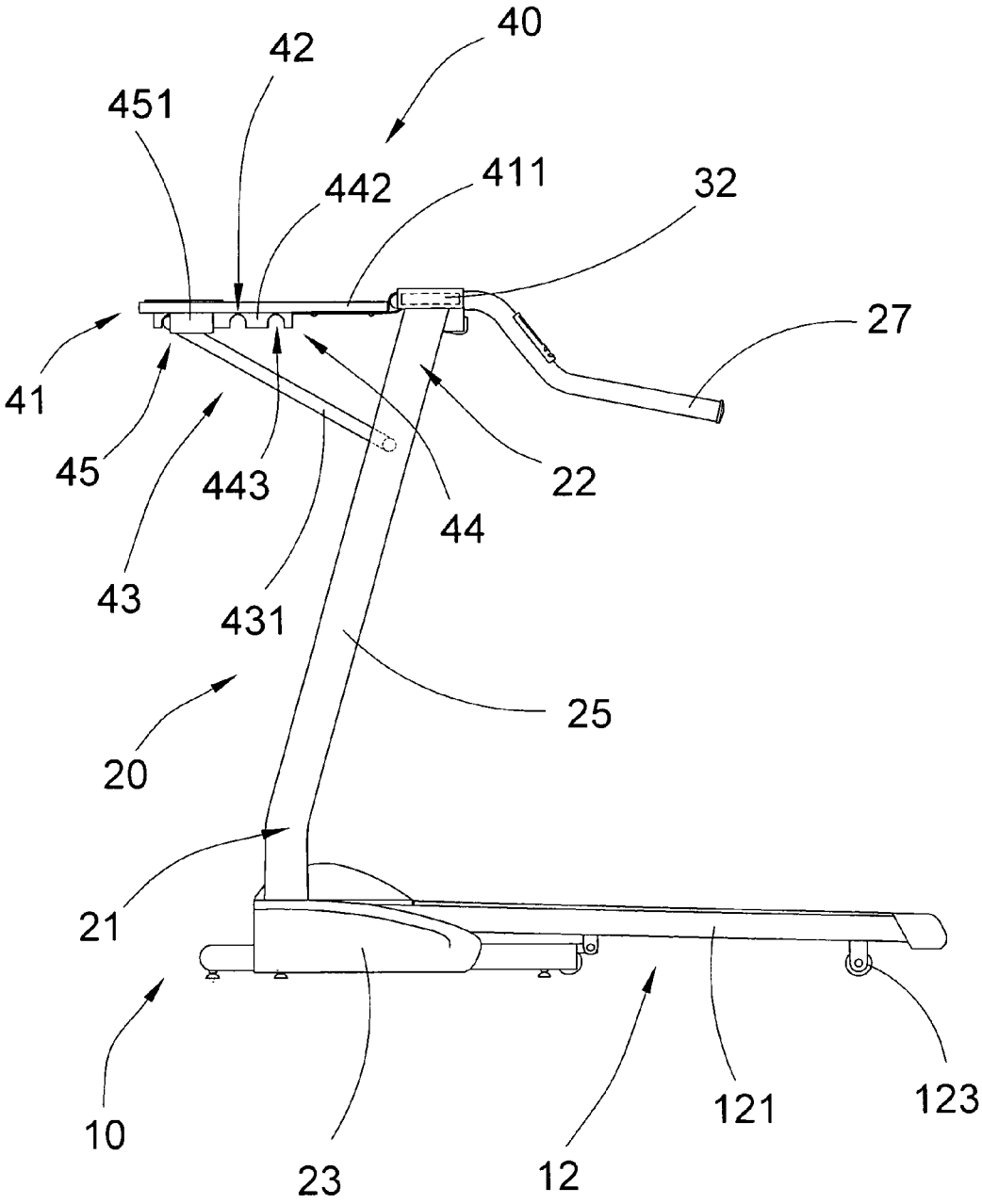
FIG. 2 is an exploded perspective view of the treadmill according to the above preferred embodiment of the present invention.

Referring to FIG. 1 to FIG. 2, FIG. 3A to FIG. 3B, FIG. 4, and FIG. 5 of the drawings, a treadmill according to a preferred embodiment of the present invention is illustrated, in which the treadmill comprises a tread assembly 10, a supporting frame 20, a control unit 30, and a tread utility assembly 40. The tread assembly 10 comprises a movable runner tread 11 for a user to run thereon.

The supporting frame 20 has a lower end portion 21 connected to a front end portion of the tread assembly 10, and an upper end portion 22 extended from the lower end portion 21 at a predetermined evaluation above the tread assembly 10.

The control unit 30 is mounted at the upper end portion 22 of the supporting frame 20 for controlling an operation of the tread assembly 10.

The tread utility assembly 40 comprises a utility member 41 outwardly and movably extended from the control unit 30 to form a utility platform 42 which has a predetermined angle of inclination with respect to the control unit 30, wherein a user is allowed to simultaneously operate the control unit 30 and run on the tread assembly 10, and accomplish a predetermined task on the utility platform 42 in a convenient and safe manner.

According to the preferred embodiment of the present invention, the tread assembly 10 comprises a base frame 12 having a first and a second guiding member 121, 122, wherein the movable runner tread 11 is operatively mounted between the first and the second guiding member 121, 122 for supporting the user and for allowing the user to run on the movable runner tread 11. The base frame 12 may also comprise a plurality of transportation wheels 123 provided on a bottom portion of the first and the second guiding member 121, 122 for facilitating easy transportation of the entire treadmill.

The supporting frame 20 comprises a first and a second base supporting member 23, 24 mounted to the first and the second guiding member 121, 122 respectively, and a first and a second frame member 25, 26 extended from the first and the second base supporting member 23, 24 respectively for supporting the control unit 30 and the tread utility assembly 40, wherein the lower end portion 22 of the supporting frame 20 is formed on the first and the second base supporting member 23, 24, while the upper end portion 21 of the supporting frame 20 is formed on the upper end portions of the first and the second frame member 25, 26.

On the other hand, the control unit 30 comprises a control housing 31 supported at the top end portion 21 of the supporting frame 20, a control module 32 received in the control housing 31 and is electrically connected to the movable runner tread 11, and a control panel 33 provided on the control housing 31 and is electrically connected to the control module 32, wherein the user is able to control the operation of the movable runner tread 11, such as running speed, by operating on the control panel 33. The commands input by the user is transmitted to the control module 32 which is arranged to send a corresponding signal to the movable runner tread 11 for adjusting the corresponding exercise parameter. It is important to mention that the control housing 31 is mounted above the movable runner tread 11 and is positioned in such a manner that the user is able to access the control panel 33 in an easy and convenient manner.

The supporting frame 20 further comprises a plurality of handle bars 27 rearwardly extended from two sides of the control housing 31, wherein the user, while exercising on the movable runner tread 11, is able to grab on the handle bars 27 for balancing and support.

The utility member 41 of the tread utility assembly 40 comprises a utility panel 411 pivotally mounted to the control housing 31 of the control unit 30 in such a manner that the utility panel 411 is arranged to be pivotally folded to be substantially aligned with the first and the second frame member 25, 26, and pivotally and adjustably unfolded to form a predetermined angle with respect to the first and the second frame member 25, 26. The tread utility assembly 40 further comprises a reinforcing frame 43 pivotally extended between the supporting frame 20 and a bottom side of the utility member 41 for providing reinforced support to the utility member 41 when it is unfolded to form the predetermined angle of inclination with the supporting frame 20.

More specifically, the reinforcing frame 43 comprises two longitudinal arms 431 each having one end pivotally connected to the corresponding first and the second frame member 25, 26, and a transverse arm 432 integrally extended between the other ends of the two longitudinal arms 431 so as to form a substantially U-shape structure of the reinforcing frame 43. This U-shaped reinforcing frame 43 is pivotally and inclinedly extended between the supporting frame 20 and the bottom side of the utility panel 411 to form a substantially triangular support structure for the utility panel 411, as shown in FIG. 3A and FIG. 3B of the drawings.

Figure 4:
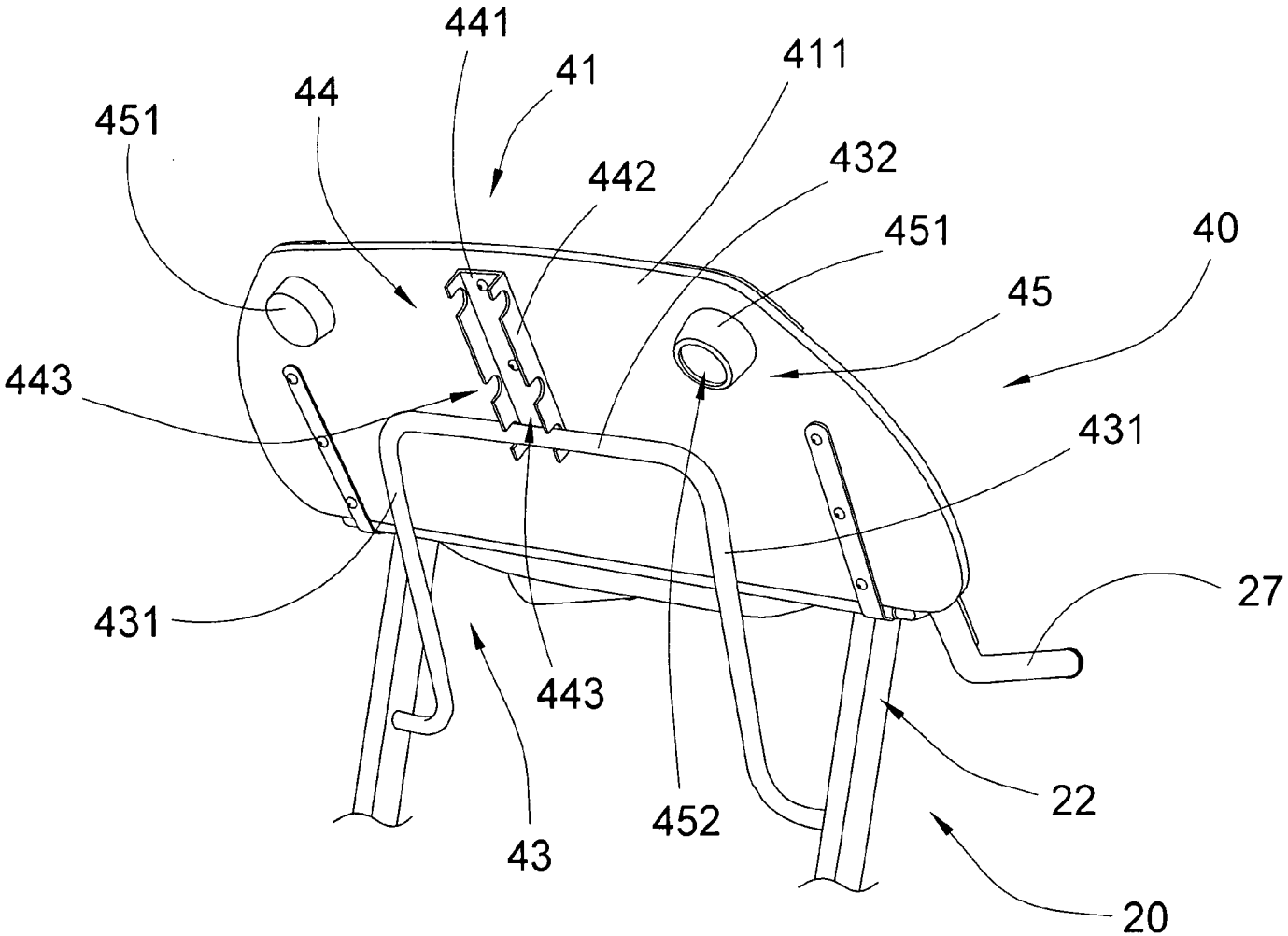
FIG. 4 is a perspective view of the utility member of the treadmill according to the above preferred embodiment of the present invention.

In order to adjust the angle of inclination, the tread utility assembly 40 further comprises a coupler 44 provided at the bottom side of the utility panel 411 for detachably and adjustably coupling with the transverse arm 432 of the reinforcing frame 43. As shown in FIG. 4 of the drawings, the coupler 44 comprises a base coupling member 441 and two side coupling members 442, and has a plurality pairs of retention slots 443 spacedly and indently formed on the side coupling members 442 in such a manner that each pair of retention slots 443 is aligned with each other for accommodating the transverse arm 432 of the reinforcing frame 43.

It is worth mentioning that each pair of retention slots 443 is spacedly formed from an adjacent pair of the retention slot 443 so as to allow the transverse arm 432 of the reinforcing frame 43 to be adjustably received in the corresponding retention slots 443 for adjusting an angle of inclination of the utility member 41. In other words, each pair of the retention slots 443 has a width which is slightly larger than a diameter of the transverse arm 432 so that the transverses arm 432 is capable of fittedly receiving in the retention slot 443. Moreover, the coupler 44 is mounted along a transverse direction (i.e. the direction which is aligned with a longitudinal direction of the movable runner tread 11) of the utility platform 42.

Figure 3A:
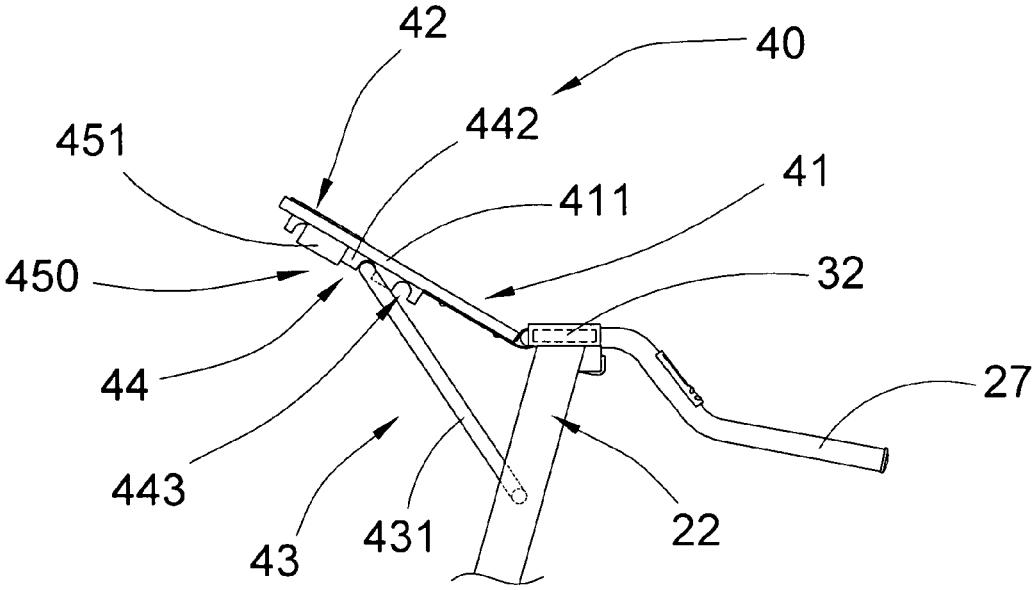
FIG. 3A and FIG. 3B are side views of the treadmill according to the above preferred embodiment of the present invention.
Figure 3B:
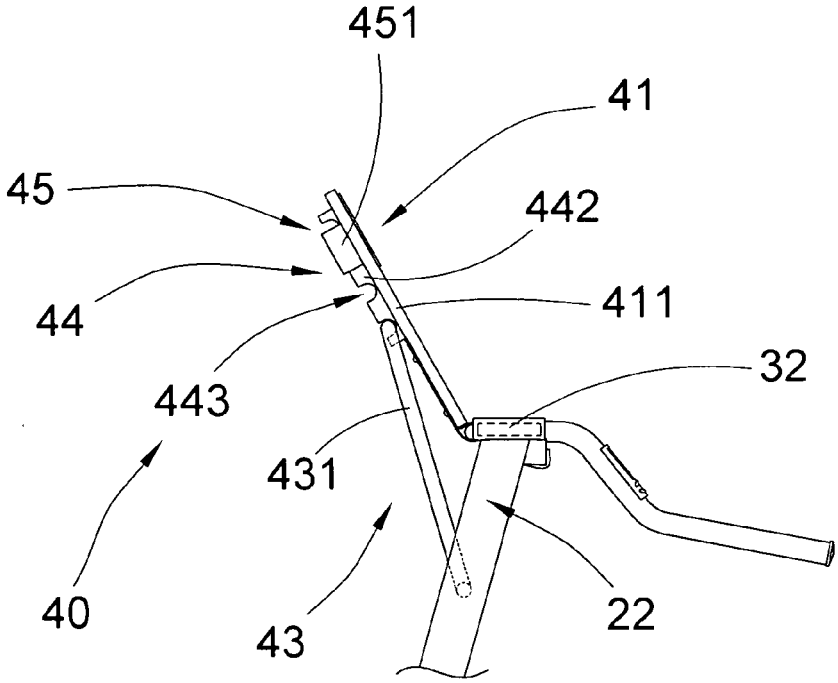

Referring to FIG. 3A to FIG. 3B of the drawings, by selectively adjusting which pair of retention slots 443 is to be mounted, the user is able adjust the angle of inclination on the part of the utility member 41. In FIG. 1, the transverse arm 432 is received in the retention slots 443 which is farthest away from the supporting frame 20 so as to allow the utility member 41 to be suspendedly supported at a substantially horizontal orientation. On the other hand, as shown in FIG. 3A of the drawings, the transverse arm 432 is received in the retention slots 443 which are formed at a mid portion of the utility member 41 so as to allow the utility member 41 to be suspendedly supported at an angle of inclination of approximately 30 degrees with respect to horizontal. As shown in FIG. 3B of the drawings, the transverse arm 432 is received in the retention slots 443 which are the closest from the supporting frame 20 so as to allow the utility member 41 to be suspendedly supported at an angle of inclination of approximately 70 degrees with respect to horizontal.

Figure 5:
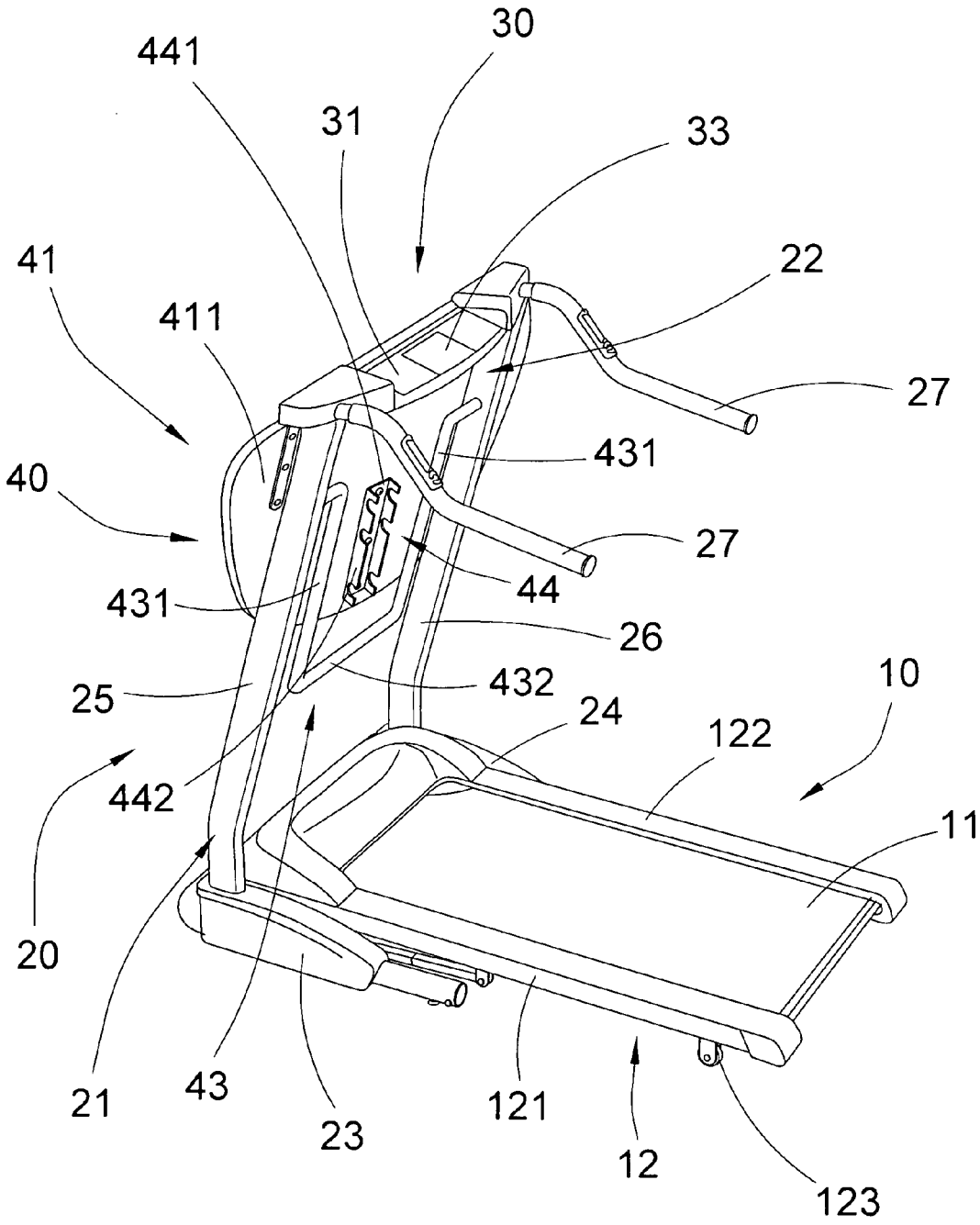
FIG. 5 is a schematic diagrams of the treadmill according to the above preferred embodiment of the present invention.

As shown in FIG. 1 of the drawings, the user may place his or her own laptop computer on to the utility member 41 so that when the user is exercising on the movable runner tread 11, he or she is able to simultaneously use his or her laptop computer for entertainment or for work purposes. In other words, the tread utility assembly 40 can be used as a workstation for the treadmill. Note that the laptop computer does not interference with the normal operation of the treadmill assembly 10 because the user is able to conveniently and easily access the control unit 30 because the control panel 33 is put nearer to the user. When the user wishes to concentrate on exercising, the user may simply ignore the laptop computer and perform exercising. As shown in FIG. 5 of the drawings, the utility member 41 can also be folded when it is not in use.

The tread utility assembly 40 further comprises a plurality of utility accessories 45 provided on the utility panel 411 of the utility member 41 for supporting the activities carried out on the utility member 41. Each of the utility accessories 45 may be embodied as a wide variety of devices or apparatuses. For example, one of the utility accessories 45 may comprise an object holder such as a cup holder or a stationary holder 451 formed on the utility member 41 for allowing the user to temporarily put a cup or his or her stationary into the utility accessory. Alternatively, the utility accessories 45 may contain a passage slot 452 formed on the utility member 41 so as to allow wires for computer to be pass therethrough.

It is worth mentioning that the user may put many other appliances other than a laptop computer onto the utility member 41 for achieving the user's specific purpose. For example, the user may put a tablet computer or a DVD player on to the utility member 41 so that the user may enjoy multimedia entertainment whole exercising. The main point here is that the utility member 41 can be embodied as a wide range of devices or apparatuses so as to fit differing users' needs.

Figure 6:
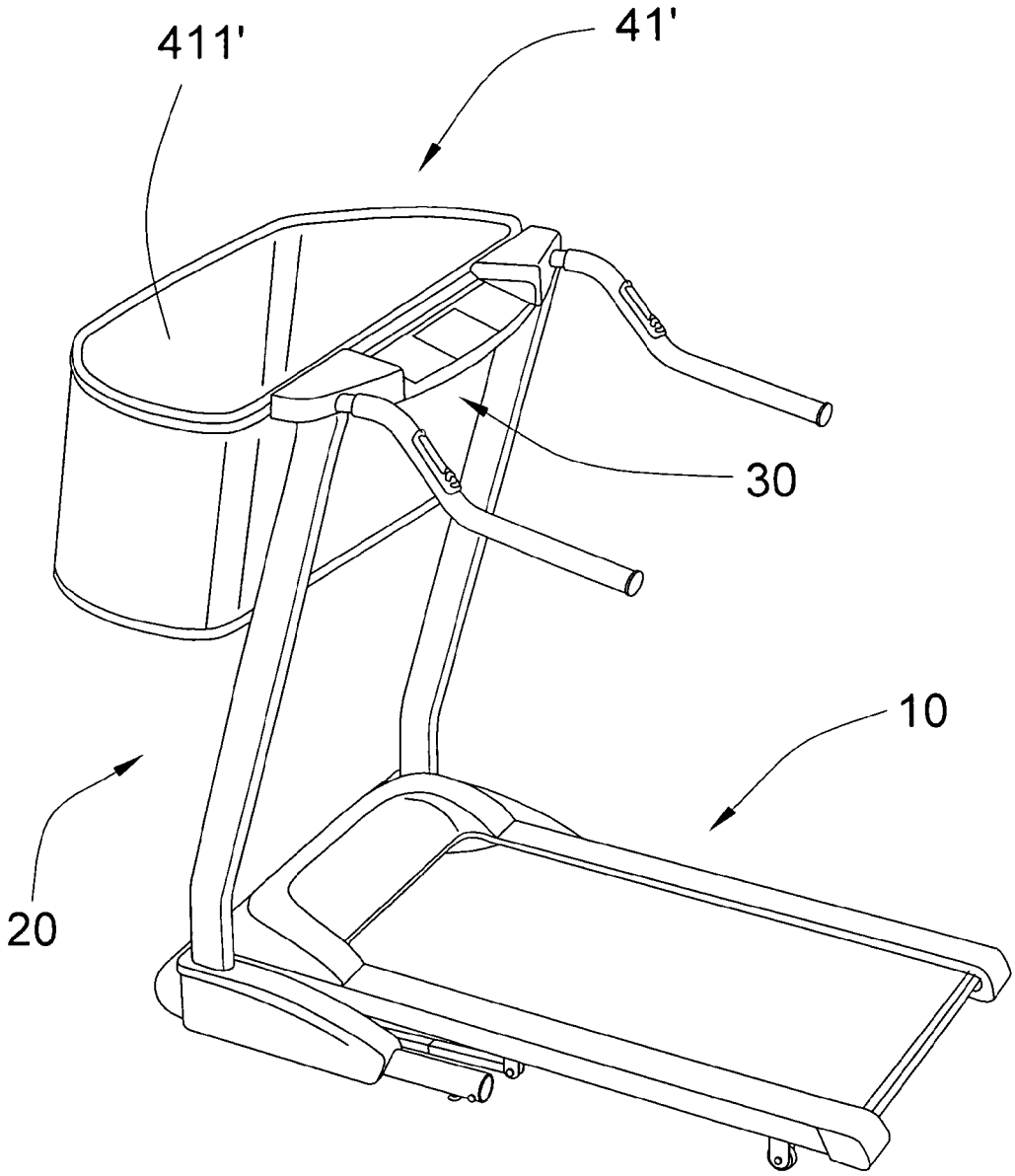
FIG. 6 is a first alternative mode of the treadmill according to the above to preferred embodiment of the present invention.

As shown in FIG. 6 of the drawings, a first alternative mode of the treadmill according to the preferred embodiment of the present invention is illustrated. The alternative mode is similar to the preferred embodiment except the utility member 41'. In this alternative mode, the utility member 41' comprises a utility basket 411' outwardly and movably extended from the control unit 30 for temporarily storing objects while the user is exercising on the movable running tread 10. The utility basket 411' is adjustably extended from the control unit 30 so as to form the angle of inclination with respect to the horizontal.

Figure 7:
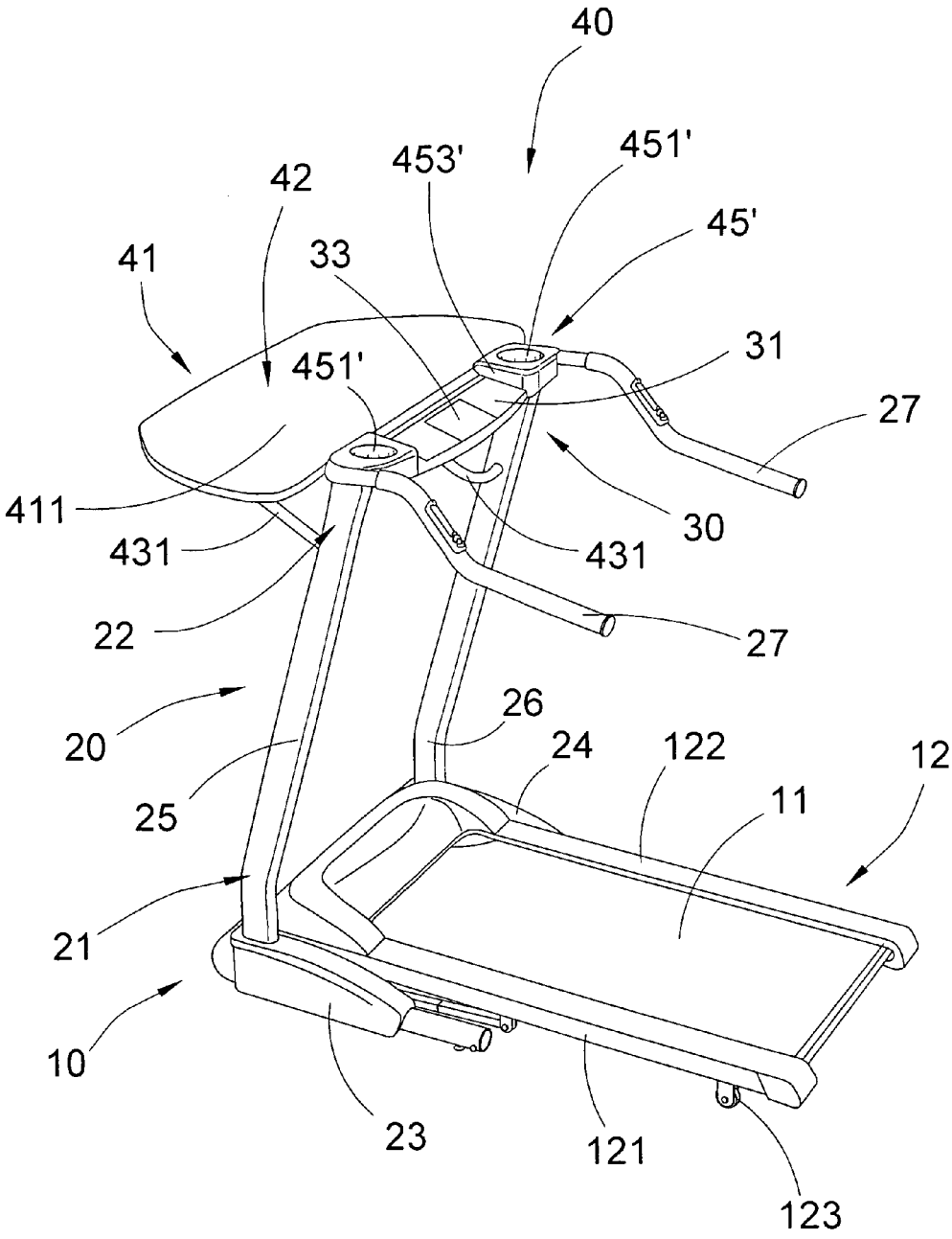
FIG. 7 is a second alternative mode of the treadmill according to the above preferred embodiment of the present invention.

Referring to FIG. 7 of the drawings, a second alternative mode of the treadmill according to the preferred embodiment of the present invention is illustrated. The second alternative mode is similar to the preferred embodiment except the utility accessory 45'. In this second alternative mode, the utility accessory 45' further comprises a plurality of cup holders 451' formed at a rear side of the utility member 41 so as to provide a convenient supply of water or drink for the user of the present invention. The utility accessory 45' further comprises an accessory platform 453' provided on at least a front end portion of one handle bar 27 and adjacent to control housing 31 of the control unit 30, wherein the cup holders 451' is on formed accessory platform 453'.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A treadmill, comprising:

a tread assembly comprising a movable runner tread for a user to run thereon;

a supporting frame having a lower end portion connected to a front end portion of said tread assembly, and an upper end portion extended from said lower end portion at a predetermined evaluation, wherein said supporting frame comprises a first and a second base supporting member and a first and a second frame member; wherein said supporting frame further comprises a plurality of handle bars;

a control unit mounted at said upper end portion of said supporting frame for controlling an operation of said tread assembly, wherein said control unit comprises a control housing supported at a top end portion of said supporting frame, a control module received in said control housing and is electrically connected to said movable runner tread, and a control panel provided on said control housing and is electrically connected to said control module, wherein a user is able to control said operation of said movable runner tread by operating on said control panel, wherein said plurality of handle bars are rearwardly extended from two sides of said control housing, wherein a user, while exercising on said movable runner tread, is able to grab on said handle bars for balancing and support and control said movable runner tread through said control unit; and a tread utility assembly comprising a utility member outwardly and movably extended from said control unit to form a utility platform which has a predetermined angle of inclination with respect to said supporting frame, wherein a user is allowed to simultaneously operate said control unit and run on said tread assembly, and accomplish a predetermined task on said utility platform in a convenient and safe manner, wherein said tread assembly comprises a base frame having a first and a second guiding member, wherein said movable runner tread is operatively mounted between said first and said second guiding member for supporting said user and for allowing said user to run on said movable runner tread, wherein said first and second base supporting members are mounted to said first and said second guiding member respectively, and said first and second frame members are upwardly extended from said first and said second base supporting member respectively for supporting said control unit and said tread utility assembly, wherein said lower end portion of said supporting frame is formed on said first and said second base supporting member, while said upper end portion of said supporting frame is formed on said upper end portions of said first and said second frame member, wherein said utility member of said tread utility assembly comprises a utility panel pivotally mounted to said control housing of said control unit in such a manner that said utility panel is arranged to be pivotally folded to be substantially aligned with said first and said second frame member and pivotally and adjustably unfolded to form a predetermined angle with respect to said first and said second frame member, wherein said tread utility assembly further comprises a reinforcing frame pivotally extended between said supporting frame and a bottom side of said utility member for providing reinforced support to said utility member when it is unfolded to form said predetermined angle of inclination with said supporting frame, wherein said tread utility assembly further comprises a coupler provided at said bottom side of said utility panel for detachably and adjustably coupling with said transverse arm of said reinforcing frame, wherein said coupler comprises a base coupling member and two side coupling members, and has a plurality pairs of retention slots spacedly and indently formed on said side coupling members in such a manner that each pair of retention slots is aligned with each other for accommodating said transverse arm of said reinforcing frame, wherein each pair of retention slots is spacedly formed from an adjacent pair of said retention slot so as to allow said transverse arm of said reinforcing frame to be adjustably received in said corresponding retention slots for adjusting an angle of inclination of said utility member.

2. The treadmill, as recited in claim 1, wherein said reinforcing frame comprises two longitudinal arms each having one end pivotally connected to said corresponding first and said second frame member, and a transverse arm integrally extended between said other ends of said two longitudinal arms so as to form a substantially U-shape structure of said reinforcing frame, wherein said U-shaped reinforcing frame is pivotally and inclinedly extended between said supporting frame and said bottom side of said utility panel to form a substantially triangular support structure for said utility panel.

3. The treadmill, as recited in claim 2, wherein said tread utility assembly further comprises a plurality of utility accessories provided on said utility panel of said utility member for supporting said activities carried out on said utility member.

4. The treadmill, as recited in claim 3, wherein said tread utility assembly further comprises a plurality of utility accessories for supporting said activities carried out on said utility member, wherein said utility accessory comprises at least one cup holder formed at a rear side of said utility member, and an accessory platform provided on at least a front end portion of one of said handle bars and adjacent to said control housing of said control unit, wherein said cup holders is formed on said accessory platform.

5. A tread utility assembly for a treadmill which comprises a tread assembly, a supporting frame comprising a first and a second frame member each having a lower end portion connected to a front end portion of said tread assembly, and an upper end portion extended from said lower end portion at a predetermined evaluation, and a control unit mounted at said upper end portion of said supporting frame for controlling an operation of said tread assembly, wherein said tread utility assembly comprises:

a utility member adapted for outwardly and movably extending from said control unit to form a utility platform which has a predetermined angle of inclination with respect to said supporting frame so that a user is allowed to simultaneously operate said control unit and run on said tread assembly, and accomplish a predetermined task on said utility platform in a convenient and safe manner, wherein said utility member of said tread utility assembly comprises a utility panel for pivotally mounting to said control unit in such a manner that said utility panel is arranged to be pivotally folded to be substantially aligned with said first and said second frame member and pivotally and adjustably unfolded to form a predetermined angle with respect to said first and said second frame member;

a reinforcing frame for pivotally extending between said supporting frame and a bottom side of said utility member providing reinforced support to said utility member when it is unfolded to form said predetermined angle of inclination with said supporting frame, wherein said reinforcing frame comprises two longitudinal arms each having one end for pivotally connecting to said corresponding first and said second frame member, and a transverse arm for integrally extending between said other ends of said two longitudinal arms so as to form a substantially U-shape structure of said reinforcing frame, wherein said U-shaped reinforcing frame is adapted for pivotally and inclinedly extending between said supporting frame and said bottom side of said utility panel to form a substantially triangular support structure for said utility panel; and a coupler provided at said bottom side of said utility panel for detachably and adjustably coupling with said transverse arm of said reinforcing frame, wherein said coupler comprises a base coupling member and two side coupling members, and has a plurality pairs of retention slots spacedly and indently formed on said side coupling members in such a manner that each pair of retention slots is aligned with each other for accommodating said transverse arm of said reinforcing frame, wherein each pair of retention slots is spacedly formed from an adjacent pair of said retention slot so as to allow said transverse arm of said reinforcing frame to be adjustably received in said corresponding retention slots for adjusting an angle of inclination of said utility member.

6. The tread utility assembly, as recited in claim 5, further comprising a plurality of utility accessories provided on said utility panel of said utility member for supporting said activities carried out on said utility member.

7. The tread utility assembly, as recited in claim 6, wherein said tread utility assembly further comprises a plurality of utility accessories for supporting said activities carried out on said utility member, wherein said utility accessory comprises at least one cup holder formed at a rear side of said utility member, and an accessory platform provided on at least a front end portion of one of said handle bars and adjacent to said control housing of said control unit, wherein said cup holders is formed on said accessory platform.

* * * * *